US010735883B2

(12) United States Patent
Tu et al.

(10) Patent No.: US 10,735,883 B2
(45) Date of Patent: Aug. 4, 2020

(54) SOUND EFFECT CONTROLLING METHOD AND SOUND OUTPUTTING DEVICE WITH ORTHOGONAL BASE CORRECTION

(71) Applicant: ACER INCORPORATED, New Taipei (TW)

(72) Inventors: Po-Jen Tu, New Taipei (TW); Jia-Ren Chang, New Taipei (TW); Kai-Meng Tzeng, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 16/531,770

(22) Filed: Aug. 5, 2019

(65) Prior Publication Data

US 2020/0084563 A1 Mar. 12, 2020

(30) Foreign Application Priority Data

Sep. 6, 2018 (TW) ..... 107131317 A

(51) Int. Cl.
*H04S 7/00* (2006.01)
*H04S 5/00* (2006.01)

(52) U.S. Cl.
CPC ..... *H04S 7/303* (2013.01); *H04S 5/00* (2013.01); *H04S 2400/13* (2013.01); *H04S 2420/01* (2013.01)

(58) Field of Classification Search
CPC ..... H04S 7/303; H04S 5/00; H04S 2400/13; H04S 2420/01
See application file for complete search history.

(56) References Cited

U.S. PATENT DOCUMENTS

2015/0170657 A1 6/2015 Thompson et al.
2017/0353812 A1* 12/2017 Schaefer ..... H04S 7/303

FOREIGN PATENT DOCUMENTS

JP 4447701 B2 4/2010
TW I313857 B 8/2009

* cited by examiner

*Primary Examiner* — Mark Fischer
(74) *Attorney, Agent, or Firm* — Birch, Stewart, Kolasch & Birch, LLP

(57) ABSTRACT

A sound effect controlling method and a sound outputting device with orthogonal base correction are provided. The sound effect controlling method includes the following steps. Firstly, 6 or 8 initial sound signals are generated according to an original left sound signal and an original right sound signal. Next, a first gain is calculated according to a rotation angle and a first axial angle, and a second gain is calculated according to the rotation angle and a second axial angle, wherein the first axial angle and the second axial angle are orthogonal. Lastly, a modified left sound signal and a modified right sound signal are obtained according to the first gain and the second gain.

19 Claims, 11 Drawing Sheets

SOUND EFFECT CONTROLLING METHOD AND SOUND OUTPUTTING DEVICE WITH ORTHOGONAL BASE CORRECTION

This application claims the benefit of Taiwan application Serial No. 107131317, filed Sep. 6, 2018, the subject matter of which is incorporated herein by reference.

BACKGROUND OF THE INVENTION

Field of the Invention

The invention relates in general to a sound effect controlling method and a sound outputting device, and more particularly to a sound effect controlling method and a sound outputting device with orthogonal base correction.

Description of the Related Art

Along with the advance of the interactive display technology, various interactive display devices are provided one after another. Let the head-mounted display (HMD) be taken for example. When the user wears the head-mounted display, the user can see a virtual reality (VR) image. As the user moves or rotates, the head-mounted display can display corresponding images, providing a sense of presence to the user.

According to the current application, although the display image can vary with the user's rotation, audio signals still remain unchanged, making the user's feeling of presence greatly jeopardized.

Particularly in a multi-channel application, when the user rotates, if the change in the ratio between the multi channels is not adjusted along with the user's rotation angle, the user's sense of presence will be greatly reduced.

SUMMARY OF THE INVENTION

The invention is directed to a sound effect controlling method and a sound outputting device with orthogonal base correction. Through the arrangement of the angles of 6 or 8 channels, the sense of direction of the 6 or 8 channels can be enhanced. Besides, a modified left sound signal and a modified right sound signal can be obtained through orthogonal base correction according to the rotation angle of the user, and the sense of presence of multi channels can therefore be greatly increased.

According to one embodiment of the present invention, a sound effect controlling method with orthogonal base correction is provided. The sound effect controlling method includes the following steps. Firstly, an original left sound signal and an original right sound signal are received. Next, 6 or 8 initial sound signals are generated according to the original left sound signal and the original right sound signal. Then, a rotation angle of a user is detected. Then, a first gain is calculated according to the rotation angle and a first axial angle, and a second gain is calculated according to the rotation angle and a second axial angle, wherein the first axial angle and the second axial angle are orthogonal. Then, the initial sound signals are transformed to a first updated left sound signal and a first updated right sound signal by using the first axial angle as a center. The initial sound signals are transformed to a second updated left sound signal and a second updated right sound signal by using the second axial angle as a center. Lastly, the first updated left sound signal and the second updated left sound signal are synthesized as a modified left sound signal according to the first gain and the second gain, and the first updated right sound signal and the second updated right sound signal are further synthesized as a modified right sound signal.

According to another embodiment of the present invention, a sound outputting device with orthogonal base correction is provided. The sound outputting device includes a reception unit, a multi-channel generation unit, a rotation detection unit, a gain calculation unit, a first transformation unit, a second transformation unit, and a synthesizing unit. The reception unit is configured to receive an original left sound signal and an original right sound signal. The multi-channel generation unit is configured to generate 6 or 8 initial sound signals according to the original left sound signal and the original right sound signal. The rotation detection unit is configured to detect a rotation angle of a user. The gain calculation unit is configured to calculate a first gain according to the rotation angle and a first axial angle and calculate a second gain according to the rotation angle and a second axial angle, wherein the first axial angle and the second axial angle are orthogonal. The first transformation unit is configured to transform the initial sound signals to a first updated left sound signal and a first updated right sound signal by using the first axial angle as a center. The second transformation unit is configured to transform the initial sound signals to a second updated left sound signal and a second updated right sound signal by using the second axial angle as a center. The synthesizing unit is configured to synthesize the first updated left sound signal and the second updated left sound signal as a modified left sound signal according to the first gain and the second gain and further synthesize the first updated right sound signal and the second updated right sound signal as a modified right sound signal.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
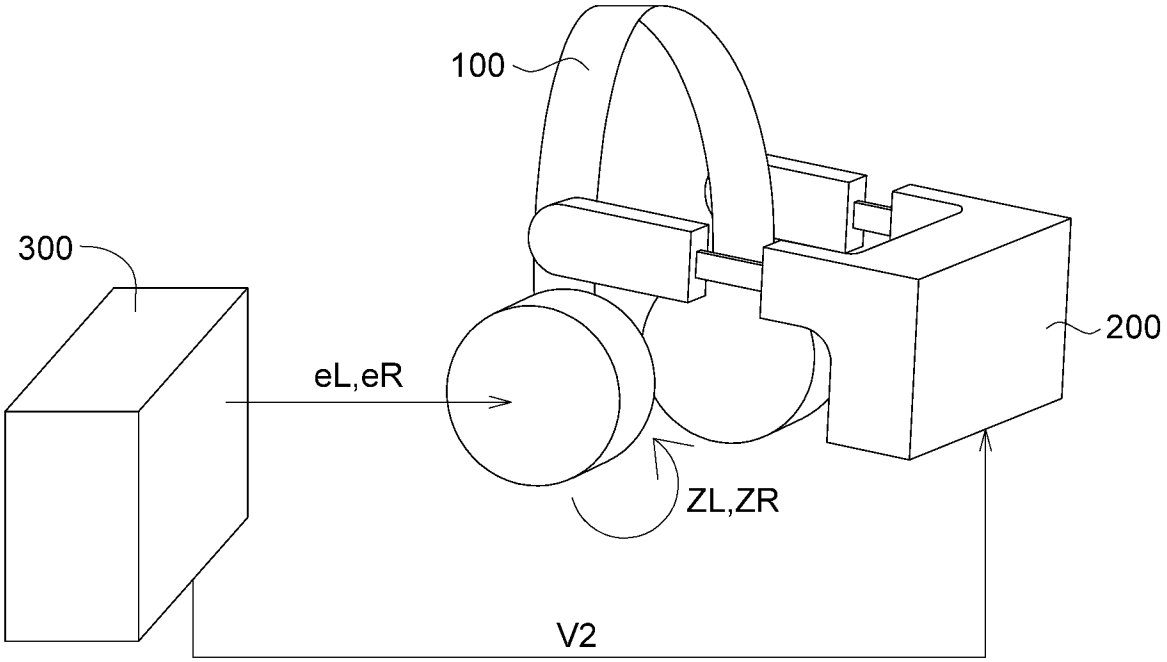
FIG. 1 is a schematic diagram of a sound outputting device, a head-mounted display and an arithmetic device according to an embodiment.

Referring to FIG. 1, a schematic diagram of a sound outputting device 100, a head-mounted display 200 and a computing device 300 according to an embodiment is shown. The sound outputting device 100 can work with the head-mounted display 200 for allowing the user to play virtual reality (VR) games or visit virtual stores. The display content V2 of the head-mounted display 200 and an original left sound signal eL and an original right sound signal eR of the sound outputting device 100 are provided by the computing device 300. As the user rotates, the display content V2 will change accordingly. In the present embodiment, the original left sound signal eL and the original right sound signal eR can be transformed to multi-channel simulation signals of 6 or 8 virtual speakers according to the user's rotation, and the multi-channel simulation signals can be modified as a modified left sound signal ZL and a modified right sound signal ZR through orthogonal base correction to increase the user's feeling of presence.

Figure 2:
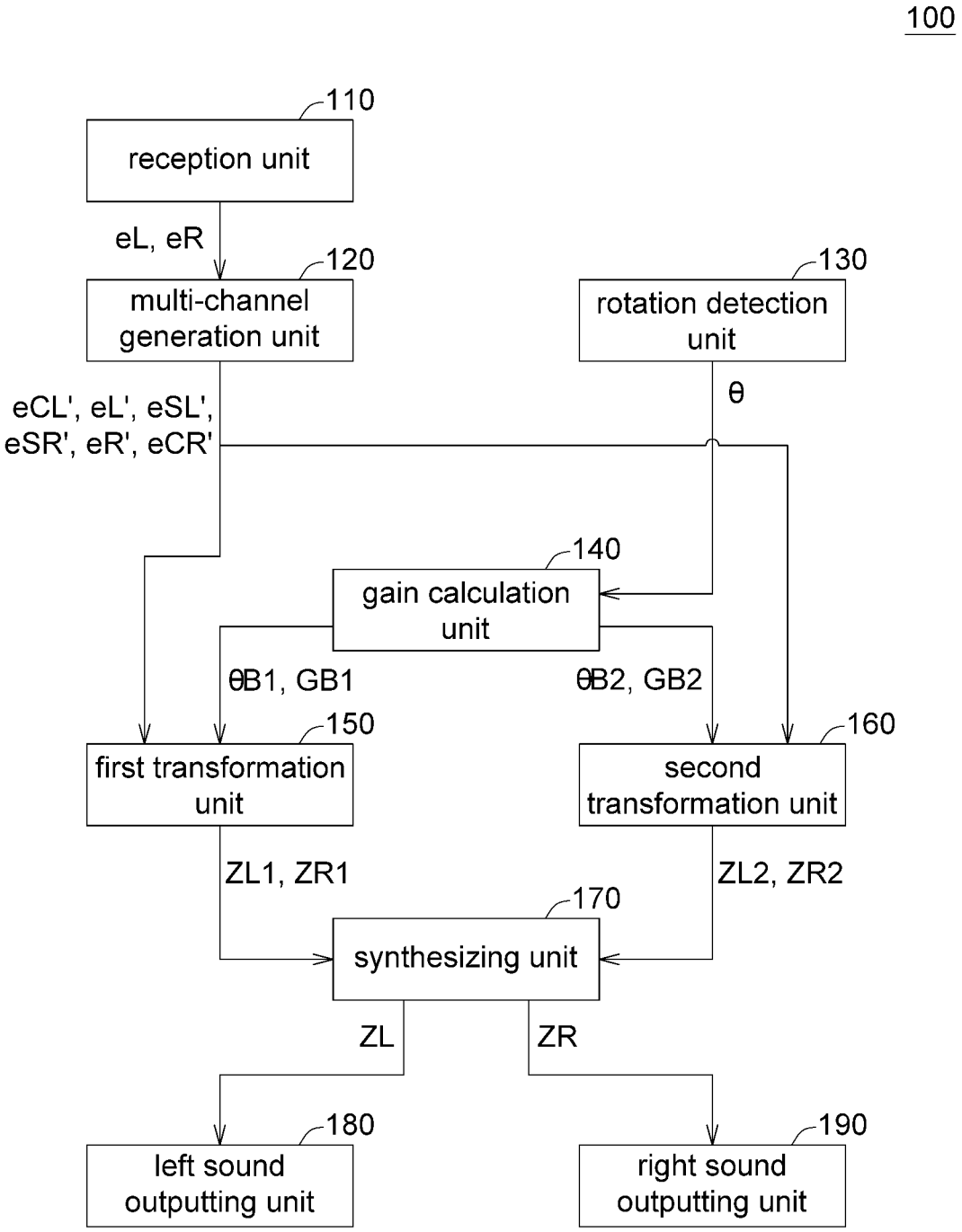
FIG. 2 is a block diagram of a sound outputting device according to an embodiment.

Referring to FIG. 2, a block diagram of the sound outputting device 100 according to an embodiment is shown. The sound outputting device 100 includes a reception unit 110, a multi-channel generation unit 120, a rotation detection unit 130, a gain calculation unit 140, a first transformation unit 150, a second transformation unit 160, a synthesizing unit 170, a left sound outputting unit 180 and a right sound outputting unit 190. The reception unit 110 is configured to receive signals, and can be realized by such as a wireless communication module, a wired network module, or an audio jack. The multi-channel generation unit 120, the gain calculation unit 140, the first transformation unit 150, the second transformation unit 160 and the synthesizing unit 170 can be realized by such as a circuit, a chip, a circuit board or a storage device storing a number of codes. The rotation detection unit 130 is configured to detect the user's rotation, and can be realized by such as a gyro, an accelerometer or an infrared detector. The left sound outputting unit 180 and the right sound outputting unit 190 can be realized by such as a headset. Operations of each element of the sound outputting device are disclosed below with an accompanying flowchart.

Figure 3:
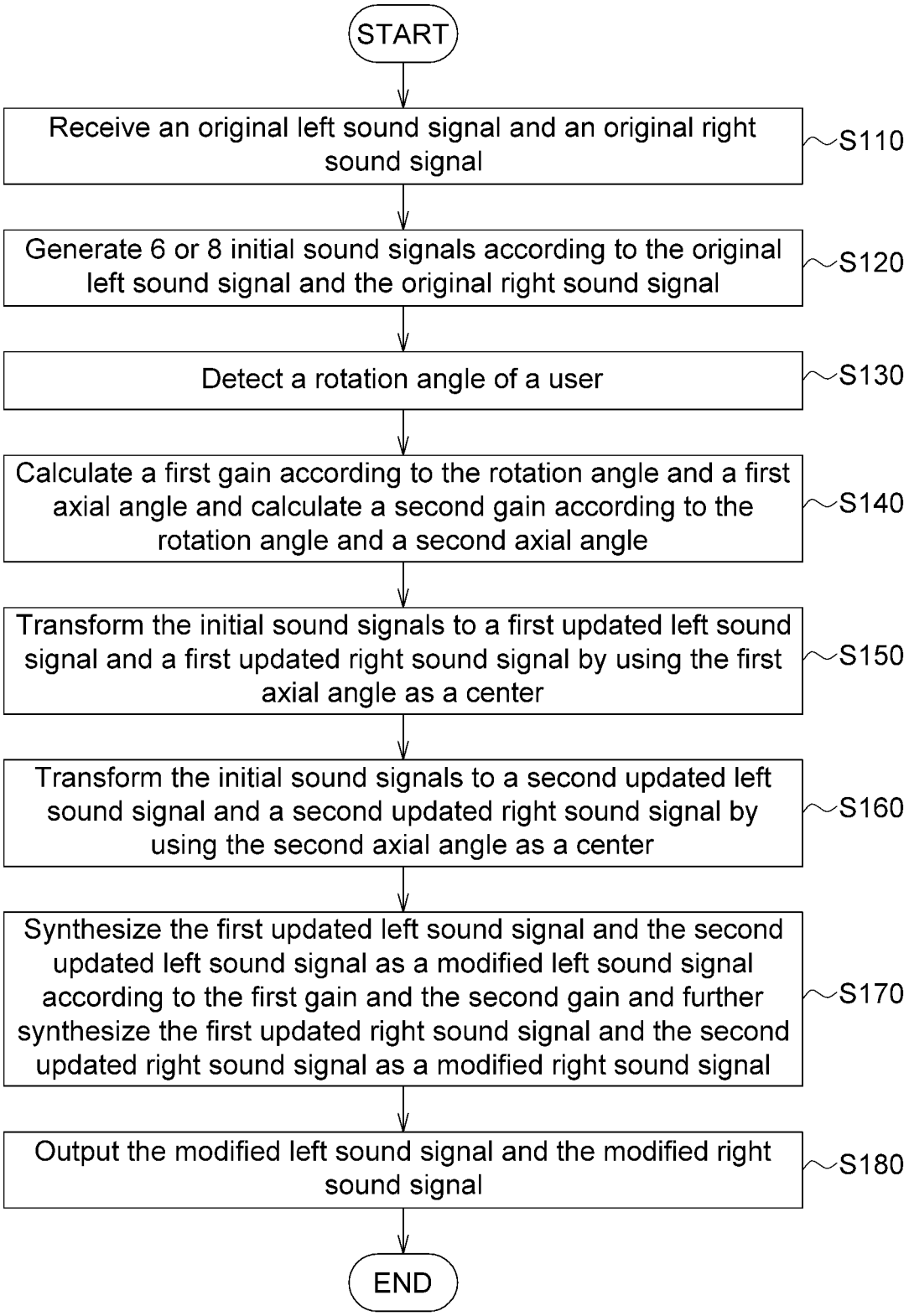
FIG. 3 is a flowchart of a sound effect controlling method with dynamic gain adjustment of according to an embodiment.

Referring to FIG. 3, a flowchart of a sound effect controlling method with dynamic gain adjustment of according to an embodiment is shown. Firstly, the method begins at step S110, the original left sound signal eL and the original right sound signal eR are received by the reception unit 110.

Figure 4A:
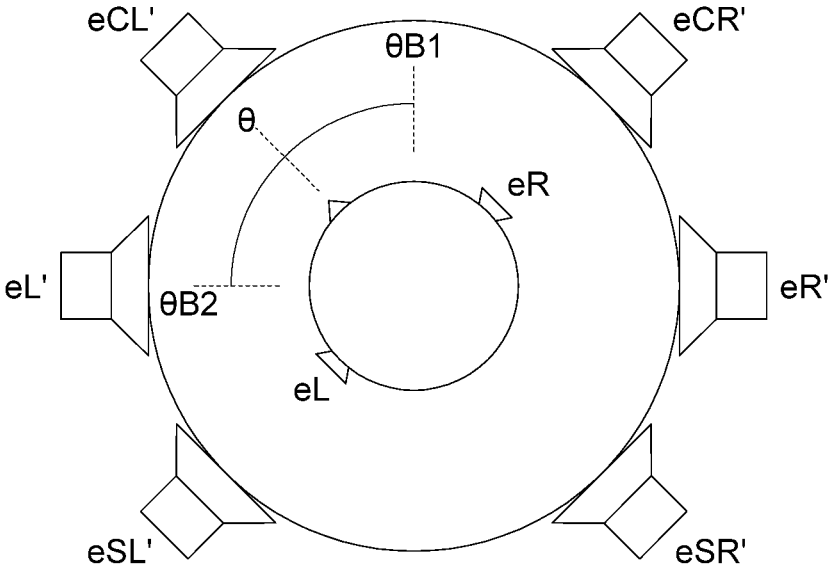
FIG. 4A is a schematic diagram of 6 initial sound signals.
Figure 4B:
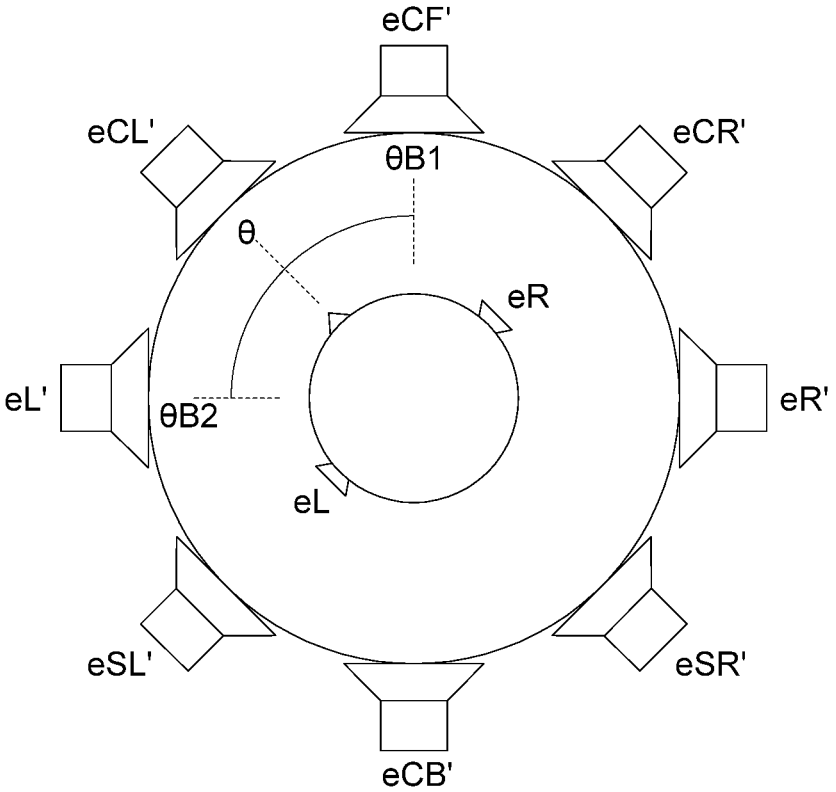
FIG. 4B is a schematic diagram of 8 initial sound signals.

Then, the method proceeds to step S120, 6 or 8 initial sound signals are generated by the multi-channel generation unit 120 according to the original left sound signal eL and the original right sound signal eR. Referring to FIG. 4A, a schematic diagram of 6 initial sound signals eCL', eL', eSL', eSR', eR' and eCR' is shown. The 6 initial sound signals eCL', eL', eSL', eSR', eR' and eCR' respectively correspond to 45°, 90°, 135°, 225°, 270° and 315°. The initial sound signal eCL' corresponding to 45° and the initial sound signal eCR' corresponding to 315° are the same. Referring to FIG. 4B, a schematic diagram of 8 initial sound signals eCF', eCL', eL', eSL', eCB', eSR', eR' and eCR' is shown. The 8 initial sound signals eCF', eCL', eL', eSL', eCB', eSR', eR' and eCR' respectively correspond to 0°, 45°, 90°, 135°, 180°, 225°, 270° and 315°. The initial sound signal eCL' corresponding to 45° and the initial sound signal eCR' corresponding to 315° are the same. The following steps are exemplified by the 6 initial sound signals eCL', eL', eSL', eSR', eR' and eCR'.

Then, the method proceeds to step S130, a rotation angle θ of a user is detected by the rotation detection unit 130. As indicated in FIG. 4A, the rotation angle θ is such as an angle rotated anti-clockwise.

Then, the method proceeds to step S140 a first gain GB1 is calculated by the gain calculation unit 140 according to the rotation angle and a first axial angle θB1, and a second gain GB2 is calculated by the gain calculation unit 140 according to the rotation angle θ and a second axial angle θ62. The first axial angle θB1 and the second axial angle θB2 are orthogonal. Moreover, the first axial angle θB1 and the second axial angle θB2 are adjacent to the rotation angle θ. For example, when the rotation angle θ is 45°, the first axial angle θB1 and the second axial angle θB2 respectively are 0° and 90°; when the rotation angle θ is 100°, the first axial angle θB1 and the second axial angle θB2 respectively are 90° and 180°; when the rotation angle θ is 200°, the first axial angle θB1 and the second axial angle θB2 respectively are 180° and 270°; when the rotation angle θ is 300°, the first axial angle θB1 and the second axial angle θB2 respectively are 270° and 0°.

The gain calculation unit 140 calculates the first gain GB1 according to formula (1).

$$GB1=\cos^2(\theta-\theta B1) \quad (1)$$

According to formula (1), the closer to the first axial angle θB1 the rotation angle θ is, the closer to 1 the first gain GB1 will be; the farther away from the first axial angle θB1 the rotation angle θ is, the closer to 0 the first gain GB1 will be.

The gain calculation unit 140 calculates the second gain GB2 according to formula (2).

$$GB2=\sin^2(\theta-\theta B1) \quad (2)$$

According to formula (2), the closer to the first axial angle θB1 the rotation angle θ is, the closer to 0 the second gain GB2 will be; the farther away from the first axial angle θB1 the rotation angle θ is, the closer to 1 the second gain GB2 will be.

That is, as the rotation angle θ gets closer to the first axial angle θB1, the first gain GB1 is larger than the second gain GB2; as the rotation angle θ gets closer to the second axial angle θB2, the second gain GB2 is larger than the first gain GB1. The first gain GB1 and the second gain GB2 reflect the distance relationship between the rotation angle θ and the first axial angle θB1 and the second axial angle θB2.

Figure 5:
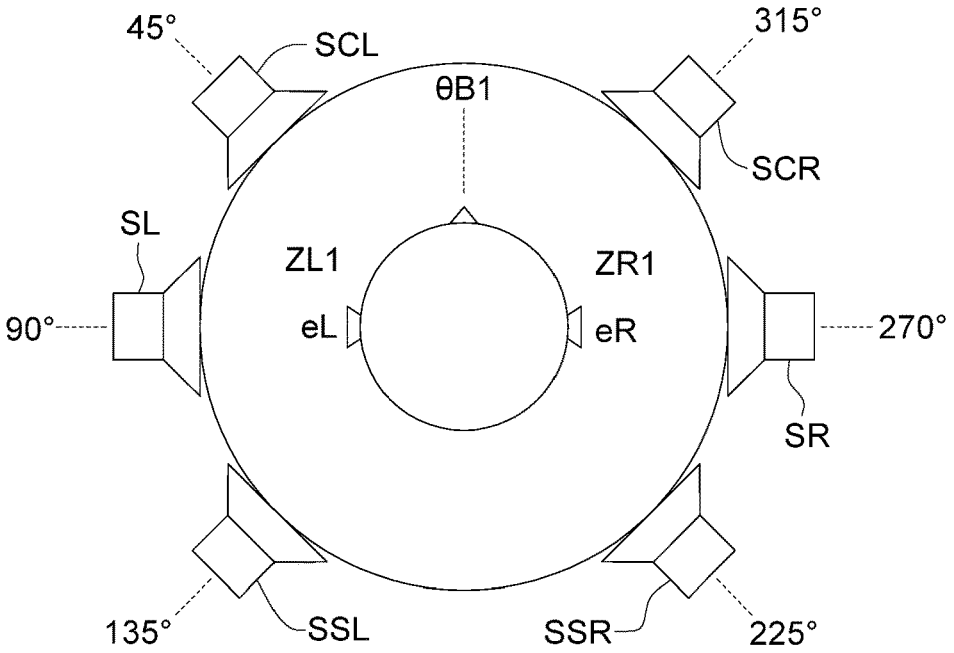
FIG. 5 is a schematic diagram of transformation using the first axial angle as a center.

Then, the method proceeds to step S150, the initial sound signal eCL', eL', eSL', eSR', eR' and eCR' are transformed to a first updated left sound signal ZL1 and a first updated right sound signal ZR1 by the first transformation unit 150 using the first axial angle θB1 as a center. Referring to FIG. 5, a schematic diagram of transformation using the first axial angle θB1 as a center is shown. The first transformation unit 150 obtains 6 virtual sound signals SCL, SL, SSL, SSR, SR and SCR by a reverse HRTF algorithm. The angles of the 6 virtual sound signals SCL, SL, SSL, SSR, SR and SCR respectively are 45°, 90°, 135°, 225°, 270° and 315°. The first transformation unit 150 again uses the first axial angle θB1 as a center and transforms the he 6 virtual sound signals SCL, SL, SSL, SSR, SR and SCR to obtain the first updated left sound signal ZL1 and the first updated right sound signal ZR1 by a forward HRTF algorithm.

Figure 6:
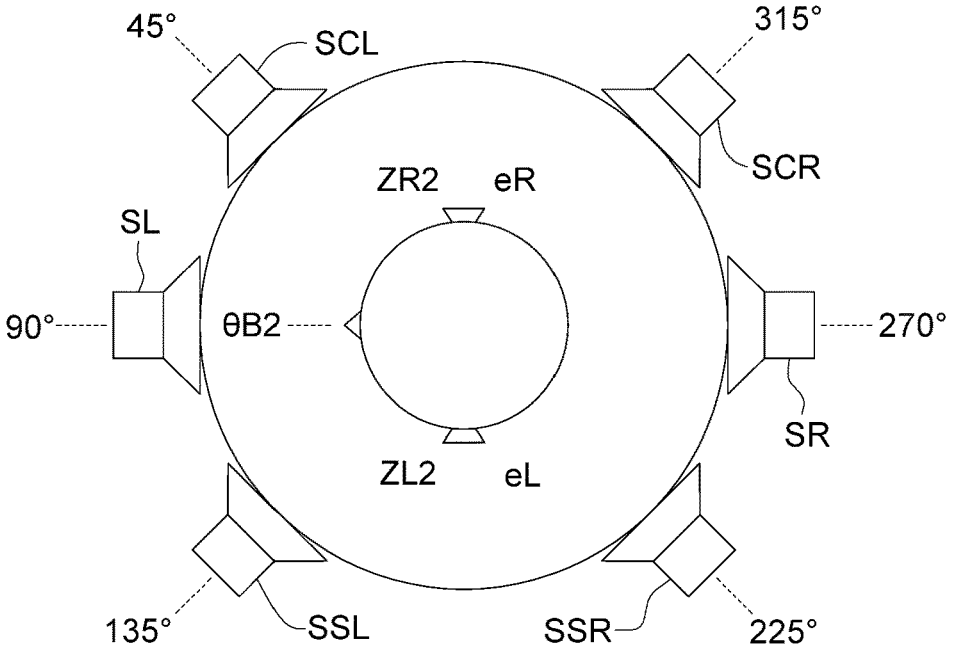
FIG. 6 is a schematic diagram of transformation using the second axial angle as a center.

Then, the method proceeds to step S160, the initial sound signals eCL', eL', eSL', eSR', eR' and eCR' are transformed to a second updated left sound signal ZL2 and a second updated right sound signal ZR2 by the second transformation unit 160 using the second axial angle θB2 as a center. Referring to FIG. 6, a schematic diagram of transformation the second axial angle θB2 as a center is shown. The second transformation unit 160 obtains 6 virtual sound signals SCL, SL, SSL, SSR, SR, and SCR by the reverse HRTF algorithm. The angles of the 6 virtual sound signals SCL, SL, SSL, SSR, SR and SCR respectively are 45°, 90°, 135°, 225°, 270° and 315°. The second transformation unit 160 again uses the second axial angle θB2 as a center and transforms the 6 virtual sound signals to obtain the second updated left sound signal ZL2 and the second updated right sound signal ZR2 by the forward HRTF algorithm.

The orders of step S150 and step S160 are exchangeable, and step S150 and step S160 can be performed at the same time.

Then, the method proceeds to step S170, the first updated left sound signal ZL1 and the second updated left sound signal ZL2 are synthesized as a modified left sound signal ZL by the synthesizing unit 170 according to the first gain GB1 and the second gain GB2, and the first updated right sound signal ZR1 and the second updated right sound signal ZR2 are further synthesized as a modified right sound signal ZR. In the present embodiment, the synthesizing unit 170 obtains the modified left sound signal ZL and the modified right sound signal ZR according to formulas (3) and (4).

$$ZL=GB1\cdot ZL1+GB2\cdot ZL2 \quad (3)$$

$$ZR-GB1\cdot ZR1+GB2\cdot ZR2 \quad (4)$$

Figure 7A:
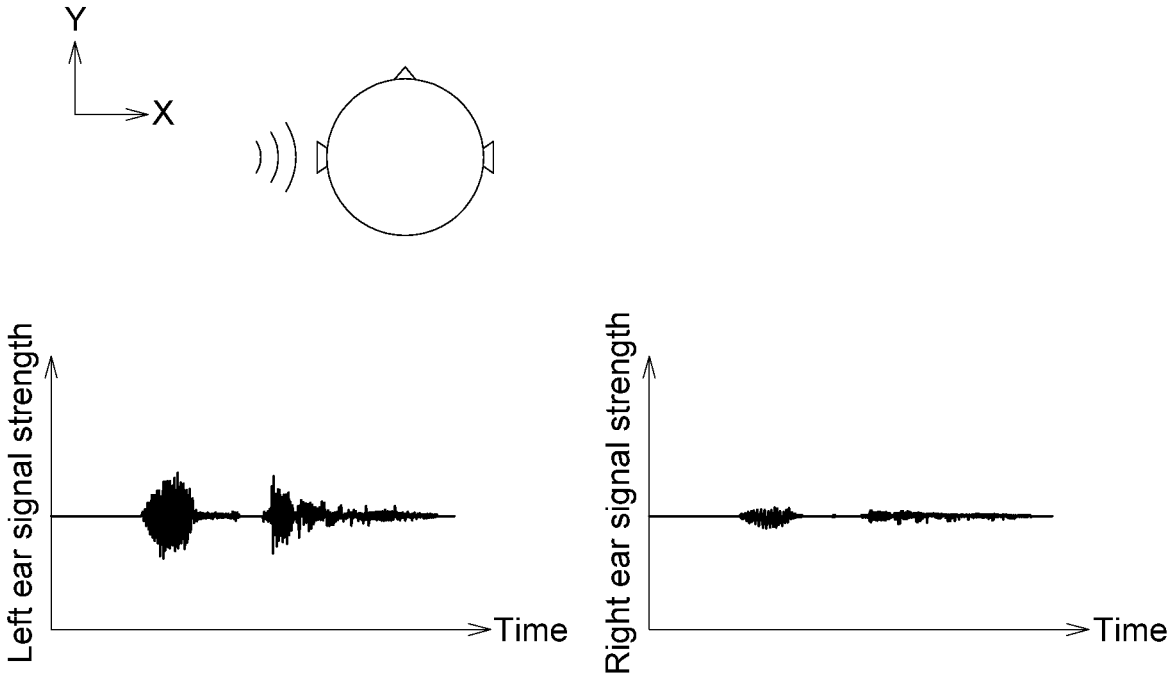
FIG. 7A is a schematic diagram of a left ear signal and a right ear signal which have not been processed with orthogonal base correction when the rotation angle is 0° and the sound source is in the negative X-axis direction.
Figure 7B:
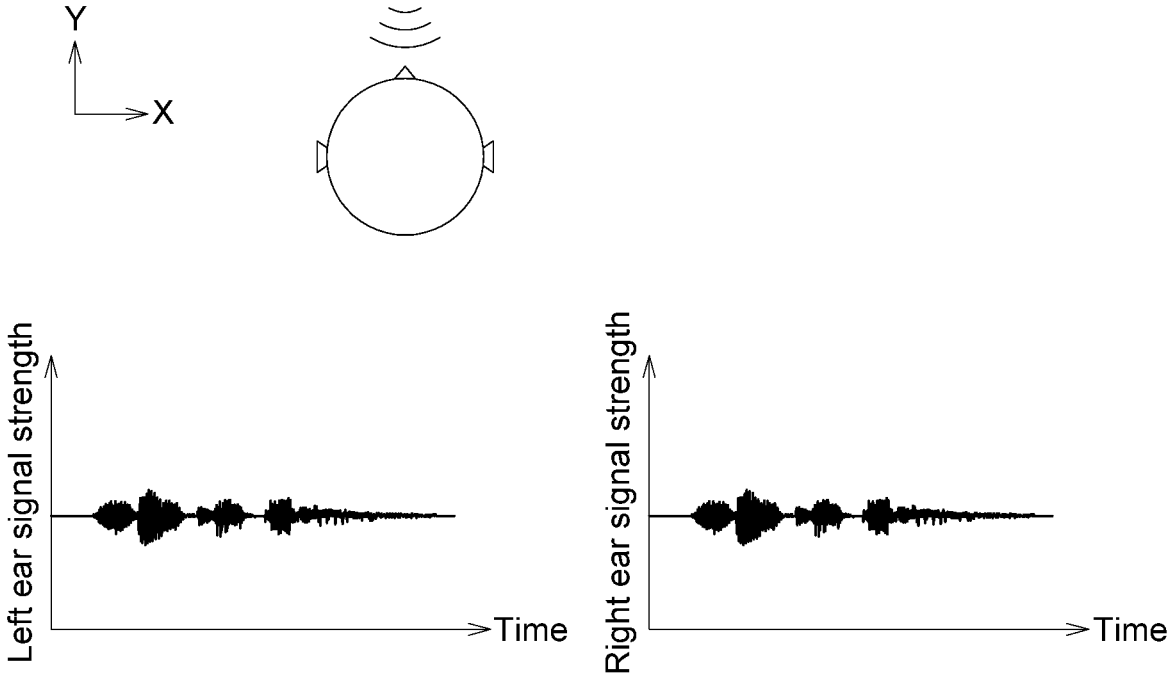
FIG. 7B is a schematic diagram of a left ear signal and a right ear signal which have not been processed with orthogonal base correction when the rotation angle is 0° and the sound source is in the positive Y-axis direction.

Refer to FIGS. 7A to 7B. FIG. 7A is a schematic diagram of a left ear signal and a right ear signal which have not been processed with orthogonal base correction when the rotation angle θ is 0° and the sound source is in the negative X-axis direction. As indicated in FIG. 7A, the left ear signal strength is significantly higher than the right ear signal strength, so the user can correctly sense the position of the sound source. FIG. 7B is a schematic diagram of a left ear signal and a right ear signal which have not been processed with orthogonal base correction when the rotation angle θ is 0° and the sound source is in the positive Y-axis direction. As indicated in FIG. 7B, the left ear signal strength and the right ear signal strength are close to each other, so the user can correctly sense the position of the sound source.

Figure 8A:
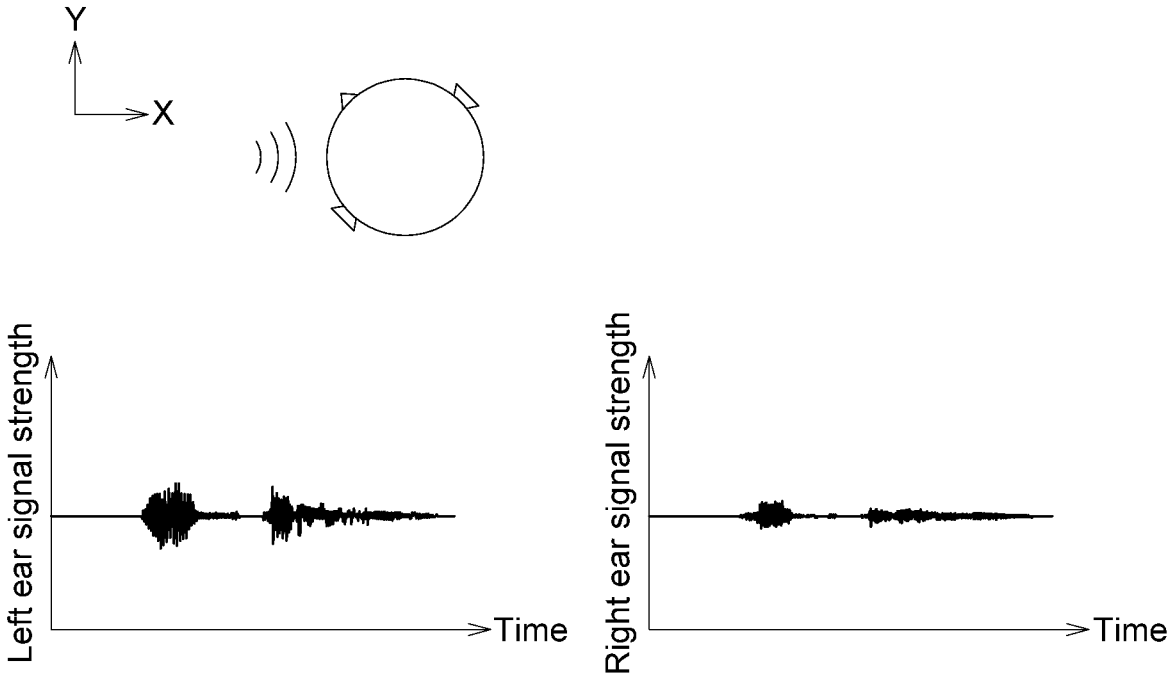
FIG. 8A is a schematic diagram of a left ear signal and a right ear signal which have not been processed with orthogonal base correction when the rotation angle is 45° and the sound source is in the negative X-axis direction.
Figure 8B:
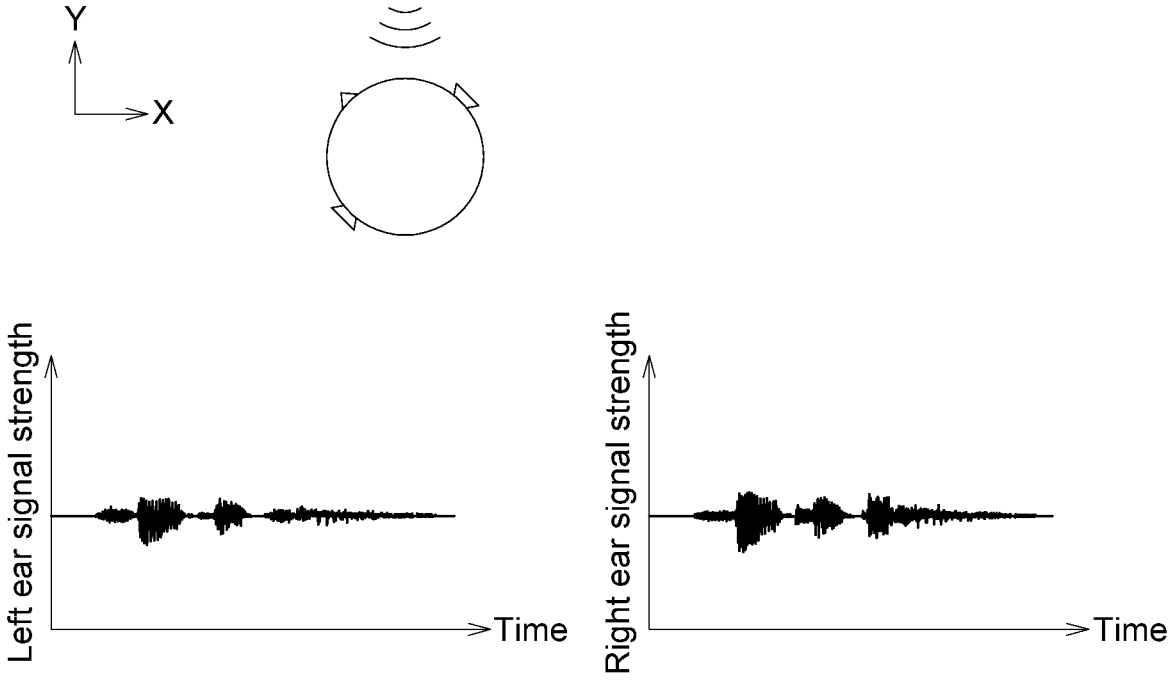
FIG. 8B is a schematic diagram of a left ear signal and a right ear signal which have not been processed with orthogonal base correction when the rotation angle is 45° and the sound source is in the positive Y-axis direction.

Refer to FIGS. 8A to 8B. FIG. 8A is a schematic diagram of a left ear signal and a right ear signal which have not been processed with orthogonal base correction when the rotation angle θ is 45° and the sound source is in the negative X-axis direction. As indicated in FIG. 8A, the right ear signal strength is higher than the left ear signal strength by 9.5 dB in average. FIG. 8B is a schematic diagram of a left ear signal and a right ear signal which have not been processed with orthogonal base correction when the rotation angle θ is 45° and the sound source is in the positive Y-axis direction. As indicated in FIG. 8B, the left ear signal strength and the right ear signal strength differ with each other only by 2 dB in average. A comparison between FIG. 8A and FIG. 8B shows that the two diagrams have different patterns of signal strength, so the user cannot correctly sense the position of the sound source.

Figure 9A:
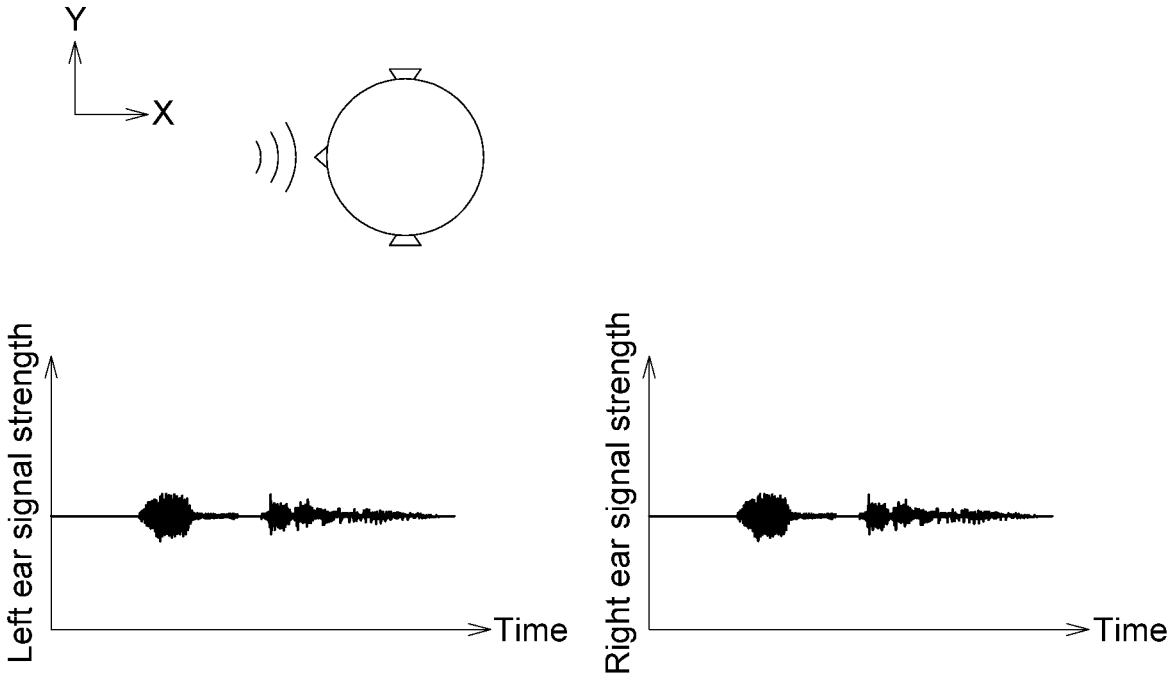
FIG. 9A is a schematic diagram of a left ear signal and a right ear signal which have not been processed with orthogonal base correction when the rotation angle is 90° and the sound source is in the negative X-axis direction.
Figure 9B:
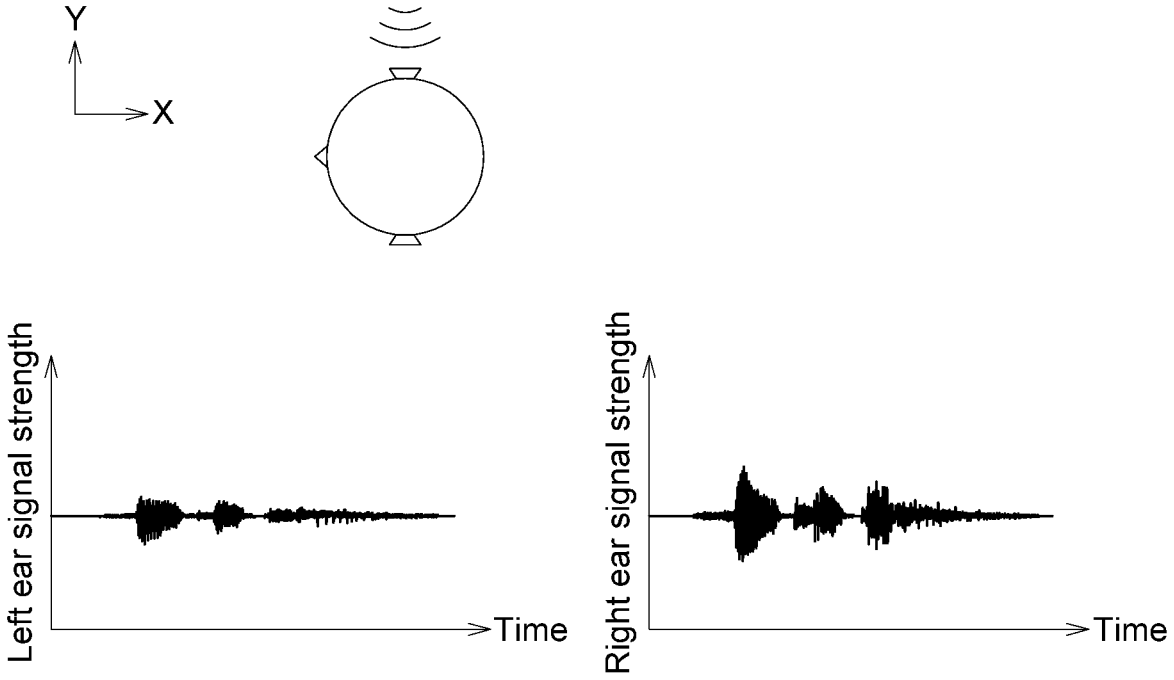
FIG. 9B is a schematic diagram of a left ear signal and a right ear signal which have not been processed with orthogonal base correction when the rotation angle is 90° and the sound source is in the positive Y-axis direction.

Refer to FIGS. 9A to 9B. FIG. 9A is a schematic diagram of a left ear signal and a right ear signal which have not been processed with orthogonal base correction when the rotation angle θ is 90° and the sound source is in the negative X-axis direction. As indicated in FIG. 9A, the right ear signal strength and the left ear signal strength are getting closer to each other. FIG. 9B is a schematic diagram of a left ear signal and a right ear signal which have not been processed with orthogonal base correction when the rotation angle θ is 90° and the sound source is in the positive Y-axis direction. As indicated in FIG. 9B, the left ear signal strength and the right ear signal strength differ with each other only by 5.5 dB in average, so the user cannot correctly sense the position of the sound source.

FIGS. 7A to 9B show that without orthogonal base correction, the user cannot correctly sense the position of the sound source. Through the technique of orthogonal base correction, the present embodiment allows the user to correctly sense the position of the sound source.

Figure 10A:
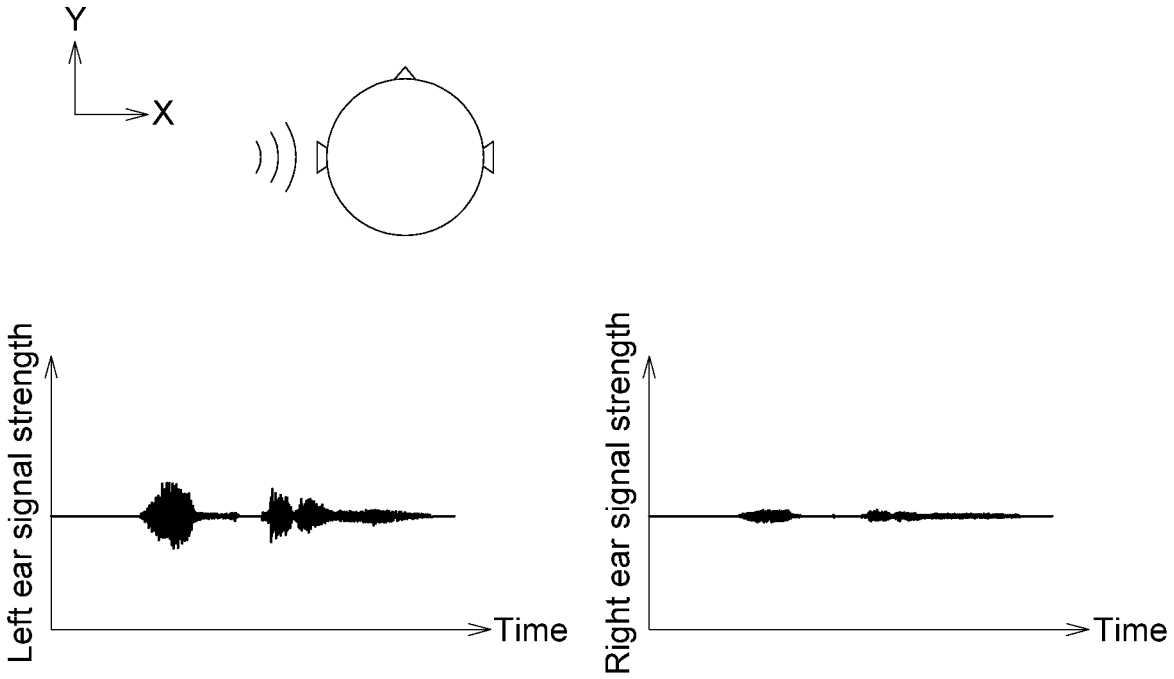
FIG. 10A is a schematic diagram of a left ear signal and a right ear signal which have been processed with orthogonal base correction when the rotation angle is 0° and the sound source is in the negative X-axis direction.
Figure 10B:
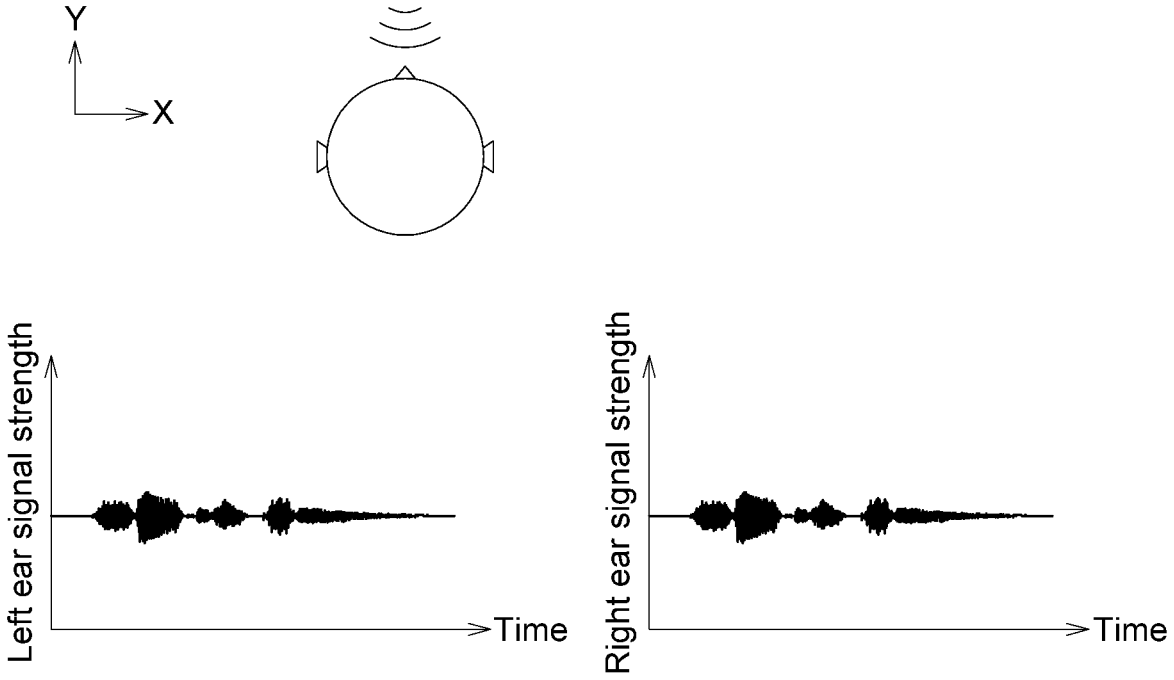
FIG. 10B is a schematic diagram of a left ear signal and a right ear signal which have been processed with orthogonal base correction when the rotation angle is 0° and the sound source is in the positive Y-axis direction.

Refer to FIGS. 10A to 10B. FIG. 10A is a schematic diagram of a left ear signal and a right ear signal which have been processed with orthogonal base correction when the rotation angle θ is 0° and the sound source is in the negative X-axis direction. As indicated in FIG. 10A, the left ear signal strength is significantly higher than the right ear signal strength, so the user can correctly sense the position of the sound source. FIG. 10B is a schematic diagram of a left ear signal and a right ear signal which have been processed with orthogonal base correction when the rotation angle θ is 0° and the sound source is in the positive Y-axis direction. As indicated in FIG. 10B, the left ear signal strength and the right ear signal strength are close to each other, so the user can correctly sense the position of the sound source.

Figure 11A:
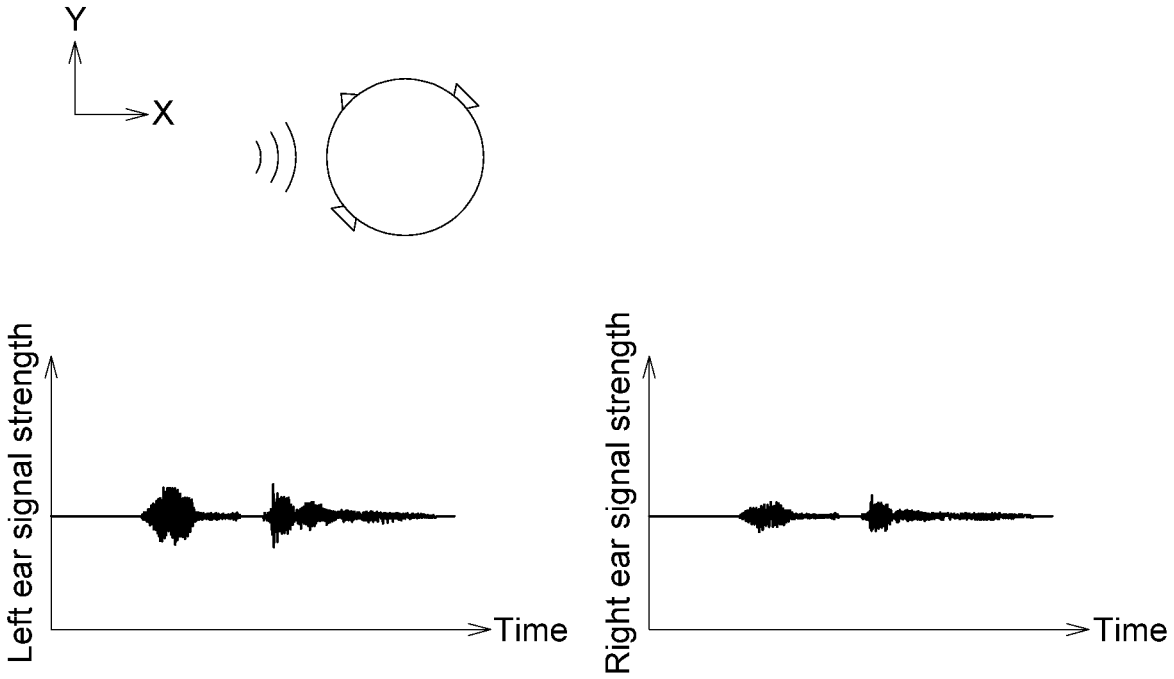
FIG. 11A is a schematic diagram of a left ear signal and a right ear signal which have been processed with orthogonal base correction when the rotation angle is 45° and the sound source is in the negative X-axis direction.
Figure 11B:
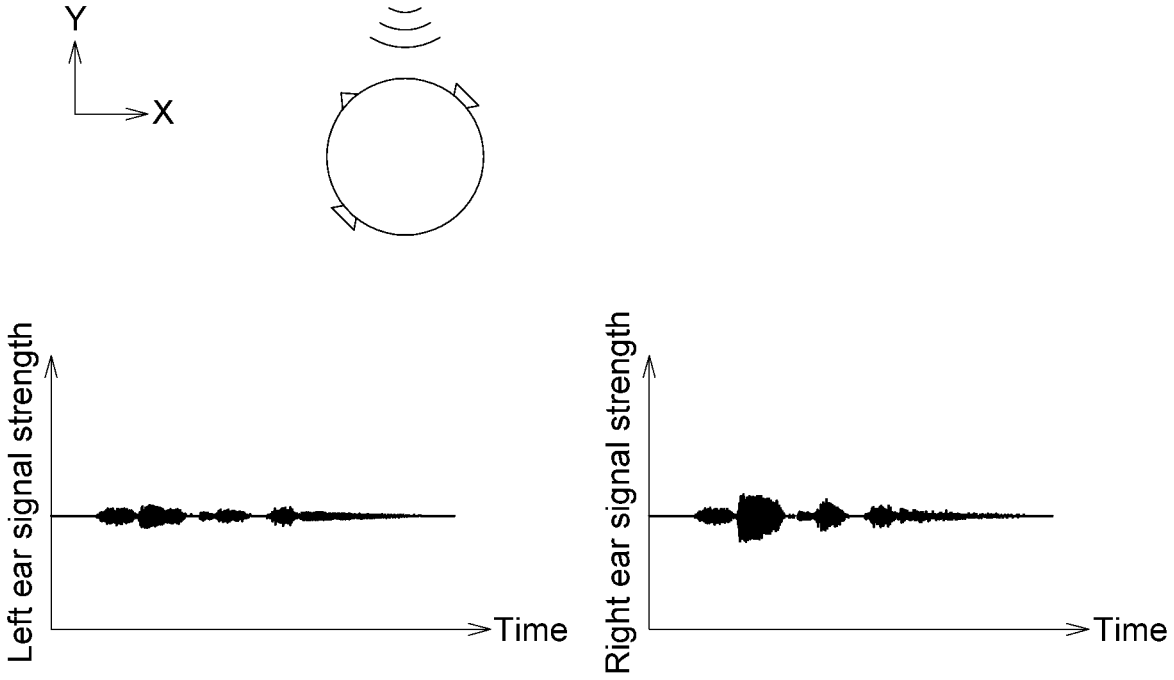
FIG. 11B is a schematic diagram of a left ear signal and a right ear signal which have been processed with orthogonal base correction when the rotation angle is 45° and the sound source is in the positive Y-axis direction.

Refer to FIGS. 11A to 11B. FIG. 11A is a schematic diagram of a left ear signal and a right ear signal which have been processed with orthogonal base correction when the rotation angle θ is 45° and the sound source is in the negative X-axis direction. As indicated in FIG. 11A, the right ear signal strength and the left ear signal strength differ with each other by 5.8 dB in average. FIG. 11B is a schematic diagram of a left ear signal and a right ear signal which have been processed with orthogonal base correction when the rotation angle θ is 45° and the sound source is in the positive Y-axis direction. As indicated in FIG. 11B, the right ear signal strength and the left ear signal strength differ with each other by 5.9 dB in average. A comparison between FIG. 11A and FIG. 11B shows that the two diagrams have similar patterns of signal strength, so the user can correctly sense the position of the sound source.

Figure 12A:
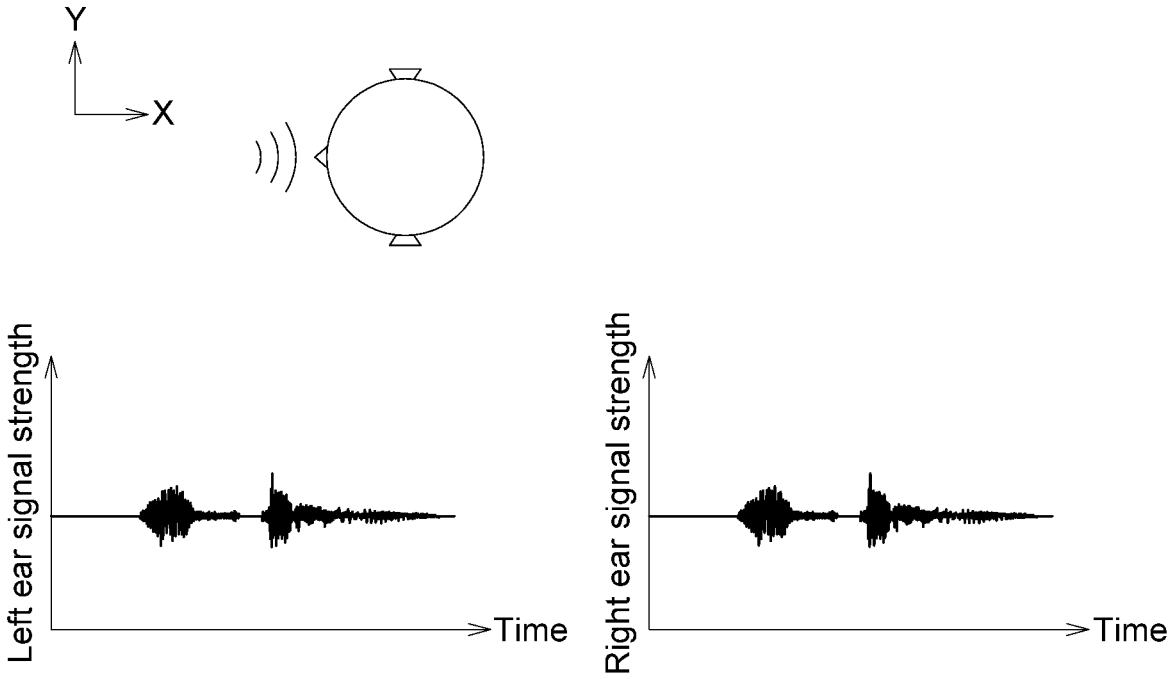
FIG. 12A is a schematic diagram of a left ear signal and a right ear signal which have been processed with orthogonal base correction when the rotation angle is 90° and the sound source is in the negative X-axis direction.
Figure 12B:
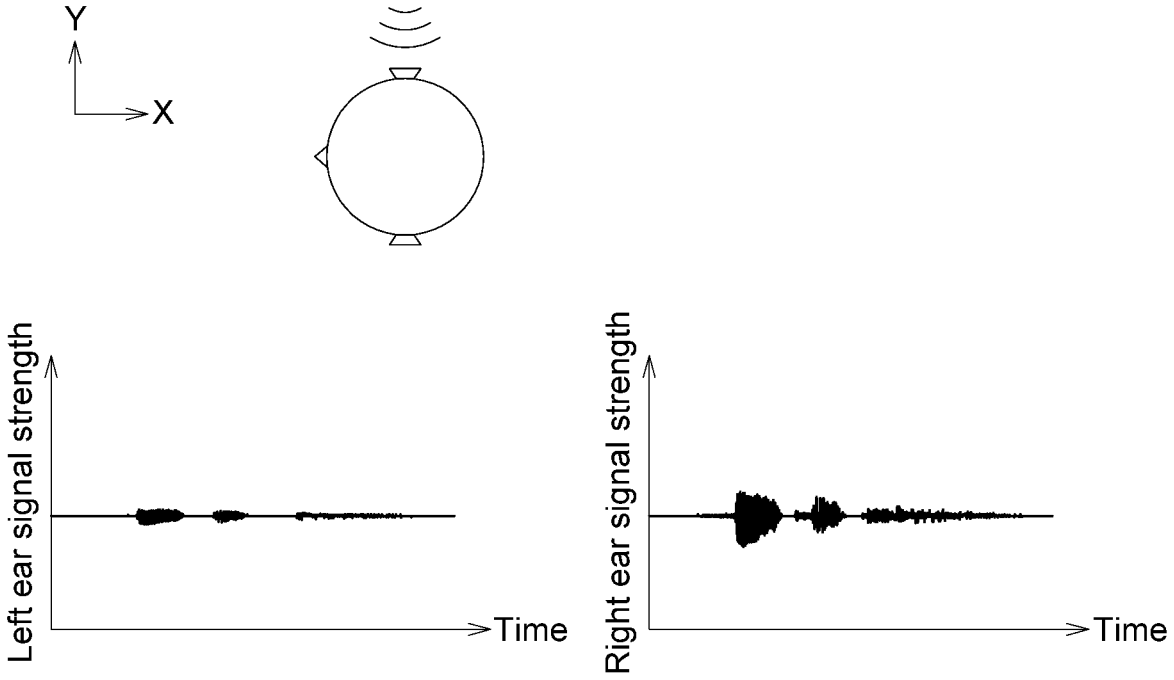
FIG. 12B is a schematic diagram of a left ear signal and a right ear signal which have been processed with orthogonal base correction when the rotation angle is 90° and the sound source is in the positive Y-axis direction.

Refer to FIGS. 12A to 12B. FIG. 12A is a schematic diagram of a left ear signal and a right ear signal which have been processed with orthogonal base correction when the rotation angle θ is 90° and the sound source is in the negative X-axis direction. As indicated in FIG. 12A, the right ear signal strength and the left ear signal strength differ with each other by 0 dB in average, so the user can correctly sense the position of the sound source. FIG. 12B is a schematic diagram of a left ear signal and a right ear signal which have been processed with orthogonal base correction when the rotation angle θ is 90° and the sound source is in the positive Y-axis direction. As indicated in FIG. 12B, the right ear signal strength and the left ear signal strength differ with each other by 10 dB in average, so the user can correctly sense the position of the sound source.

According to the above embodiments, through the arrangement of the angles of 6 or 8 channels, the sense of direction of the 6 or 8 channels can be enhanced. Besides, a modified left sound signal ZL and a modified right sound signal ZR can be obtained through orthogonal base correction according to the rotation angle θ of the user, and the sense of presence of multi channels can therefore be greatly increased.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A sound effect controlling method with orthogonal base correction, comprising:

receiving an original left sound signal and an original right sound signal;

generating 6 or 8 initial sound signals according to the original left sound signal and the original right sound signal;

detecting a rotation angle of a user;

calculating a first gain according to the rotation angle and a first axial angle and calculating a second gain according to the rotation angle and a second axial angle, wherein the first axial angle and the second axial angle are orthogonal;

transforming the initial sound signals to a first updated left sound signal and a first updated right sound signal by using the first axial angle as a center;

transforming the initial sound signals to a second updated left sound signal and a second updated right sound signal by using the second axial angle as a center; and synthesizing the first updated left sound signal and the second updated left sound signal as a modified left sound signal according to the first gain and the second gain and further synthesizing the first updated right sound signal and the second updated right sound signal as a modified right sound signal;

wherein the first gain is calculated according to a following formula:

$GB1=\cos^2(\theta-\theta B1)$, GB1 is the first gain, θ is the rotation angle, and θB1 is the first axial angle.

2. The sound effect controlling method with orthogonal base correction according to claim 1, wherein the first axial angle and the second axial angle are adjacent to the rotation angle.

3. The sound effect controlling method with orthogonal base correction according to claim 1, wherein the initial sound signals correspond to 45°, 90°, 135°, 225°, 270° and 315° and have a quantity of 6.

4. The sound effect controlling method with orthogonal base correction according to claim 3, wherein the initial sound signals corresponding to 45° and 315° are the same.

5. The sound effect controlling method with orthogonal base correction according to claim 1, wherein the first gain is calculated through a cosine function, and the second gain is calculated through a sinusoidal function.

6. The sound effect controlling method with orthogonal base correction according to claim 1, wherein the initial sound signals correspond to 0°, 45°, 90°, 135°, 180°, 225°, 270° and 315° and have a quantity of 8.

7. The sound effect controlling method with orthogonal base correction according to claim 1, wherein the second gain is calculated according to a following formula:

$GB2=\sin^2(\theta-\theta B1)$, GB2 is the second gain, θ is the rotation angle, and θB2 is the second axial angle.

8. The sound effect controlling method with orthogonal base correction according to claim 1, wherein the initial sound signals are transformed to 6 virtual sound signals by a reverse HRTF algorithm, and the virtual sound signals are transformed to the first updated left sound signal and the first updated right sound signal by a forward HRTF algorithm.

9. The sound effect controlling method with orthogonal base correction according to claim 1, wherein the initial sound signals are transformed to 6 virtual sound signals by a reverse HRTF algorithm, and the virtual sound signals are transformed to the second updated left sound signal and the second updated right sound signal by a forward HRTF algorithm.

10. A sound outputting device with orthogonal base correction, comprising:

a reception unit configured to receive an original left sound signal and an original right sound signal;

a multi-channel generation unit configured to generate 6 or 8 initial sound signals according to the original left sound signal and the original right sound signal;

a rotation detection unit configured to detect a rotation angle of a user;

a gain calculation unit configured to calculate a first gain according to the rotation angle and a first axial angle and calculate a second gain according to the rotation angle and a second axial angle, wherein the first axial angle and the second axial angle are orthogonal;

a first transformation unit configured to transform the initial sound signals to a first updated left sound signal and a first updated right sound signal by using the first axial angle as a center;

a second transformation unit configured to transform the initial sound signals to a second updated left sound signal and a second updated right sound signal by using the second axial angle as a center; and a synthesizing unit configured to synthesize the first updated left sound signal and the second updated left sound signal as a modified left sound signal according to the first gain and the second gain and further synthesize the first updated right sound signal and the second updated right sound signal as a modified right sound signal;

wherein the gain calculation unit calculates the first gain according to a following formula:

$GB1=\cos^2(\theta-\theta B1)$, GB1 is the first gain, θ is the rotation angle, and θB1 is the first axial angle.

11. The sound outputting device with orthogonal base correction according to claim 10, wherein the first axial angle and the second axial angle are adjacent to the rotation angle.

12. The sound outputting device with orthogonal base correction according to claim 10, wherein the initial sound signals correspond to 45°, 90°, 135°, 225°, 270° and 315° and have a quantity of 6.

13. The sound outputting device with orthogonal base correction according to claim 12, wherein the initial sound signals corresponding to 45° and 315° are the same.

14. The sound outputting device with orthogonal base correction according to claim 10, wherein the first gain is calculated through a cosine function, and the second gain is calculated through a sinusoidal function.

15. The sound outputting device with orthogonal base correction according to claim 10, wherein the initial sound signals correspond to 0°, 45°, 90°, 135°, 180°, 225°, 270° and 315° and have a quantity of 8.

16. The sound outputting device with orthogonal base correction according to claim 10, wherein the gain calculation unit calculates the second gain according to a following formula:

$GB2=\sin^2(\theta-\theta B1)$, GB2 is the second gain, θ is the rotation angle, and θB2 is the second axial angle.

17. The sound outputting device with orthogonal base correction according to claim 10, wherein the first transformation unit transforms the initial sound signals to 6 virtual sound signals by a reverse HRTF algorithm, and transforms the virtual sound signals to the first updated left sound signal and the first updated right sound signal by a forward HRTF algorithm.

18. The sound outputting device with orthogonal base correction according to claim 10, wherein the second transformation unit transforms the initial sound signals to 6 virtual sound signals by a reverse HRTF algorithm, and transforms the virtual sound signals to the second updated left sound signal and the second updated right sound signal by a forward HRTF algorithm.

19. A sound effect controlling method with orthogonal base correction, comprising:

receiving an original left sound signal and an original right sound signal;

generating 6 or 8 initial sound signals according to the original left sound signal and the original right sound signal;

detecting a rotation angle of a user;

calculating a first gain according to the rotation angle and a first axial angle and calculating a second gain according to the rotation angle and a second axial angle, wherein the first axial angle and the second axial angle are orthogonal;

transforming the initial sound signals to a first updated left sound signal and a first updated right sound signal by using the first axial angle as a center;

transforming the initial sound signals to a second updated left sound signal and a second updated right sound signal by using the second axial angle as a center; and synthesizing the first updated left sound signal and the second updated left sound signal as a modified left sound signal according to the first gain and the second gain and further synthesizing the first updated right sound signal and the second updated right sound signal as a modified right sound signal;

wherein the second gain is calculated according to a following formula:

$GB2=\sin^2(\theta-\theta B1)$, GB2 is the second gain, θ is the rotation angle, and θB2 is the second axial angle.

* * * * *